United States Patent [19]

Wernli et al.

[11] 4,396,095

[45] Aug. 2, 1983

[54] LIFT LINE TENSION LIMITER

[75] Inventors: Robert L. Wernli; James M. Walton; Jimmy L. Held, all of San Diego, Calif.

[73] Assignee: The United States of America as represented by the Secretary of the Navy, Washington, D.C.

[21] Appl. No.: 299,748

[22] Filed: Sep. 8, 1981

[51] Int. Cl.[3] ..... B65H 59/16

[52] U.S. Cl. ..... 188/65.3; 188/65.1; 188/65.2; 294/78 A

[58] Field of Search ..... 294/74, 78 R, 78 A, 294/82 R; 24/115 R, 115 F, 115 G, 115 M, 115 T, 118, 127, 136 R, 136 K, 136 L, 129 R, 129 A; 74/501.5 R; 114/210, 215; 182/5, 231, 233, 235; 188/65.1–65.5; 242/147 R, 149, 150 R, 153, 154, 156

[56] References Cited

U.S. PATENT DOCUMENTS

| | | | |
|---|---|---|---|
| 1,061,330 | 5/1913 | Self | 242/149 |
| 1,198,926 | 9/1916 | Kemp | 188/65.5 |
| 1,450,176 | 4/1923 | Hopkins | 24/115 G |
| 2,646,943 | 7/1953 | Lindsay | 242/150 |
| 2,680,577 | 6/1954 | Frieder et al. | 188/65.5 X |
| 3,120,043 | 2/1964 | Henley | 24/132 |
| 3,250,515 | 5/1966 | Hudnall et al. | 188/65.4 |
| 3,293,839 | 12/1966 | Yanobu | 242/153 X |
| 3,351,158 | 11/1967 | Kite | 188/65.4 |
| 3,352,510 | 11/1967 | Franzen | 242/149 |
| 3,456,907 | 7/1969 | Marcheron | 188/65.1 |

*Primary Examiner*—Johnny D. Cherry

*Attorney, Agent, or Firm*—Robert F. Beers; Ervin F. Johnston; Thomas Glenn Keough

[57] ABSTRACT

A lift line tension limiter is provided which includes a lift line and a container which is adapted to contain the lift line. The container has a lift end and a payload end, the payload end having an aperture for the passage of the lift line therethrough. A device is spring mounted to the container for pinching the lift line at the container aperture, and after the container aperture the lift line is in frictional engagement with the pinching device so that a force on the lift line will decrease the pinching action on the lift line. With this arrangement a predetermined loading of the lift line will spring bias the pinching device to relieve the pinching force and allow a portion of the lift line to be payed out of the container until the loading has been lessened below the predetermined amount.

13 Claims, 4 Drawing Figures

LIFT LINE TENSION LIMITER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

For years the U.S. Navy has been actively involved in research and development of salvage equipment. The most challenging research and development work has been providing equipment for recovering high density objects, such as aircraft, practice torpedoes, and other metal apparatuses. The recovery of high density objects which do not have appendages or other points for attachment require an initial installation of several attachment devices to prepare them for a lift. The attachment devices may be bolt and nut combinations, bearing elements which rotate eccentrically into an operating mode, and/or bolts threaded into the object after a drilling and tapping operation. Any one of these devices has an eye or hook for receiving a lift line. The problem in lifting a heavy object by a plurality of attachment devices is obtaining a reasonable distribution of forces. It too much force is applied by one lift line on a respective attachment device it will break away from the object which is likely to result in a domino effect of the other attachment devices being broken away. There is a need for an arrangement for automatically obtaining a substantially equal distribution of loading on the various attachment devices as the lifting operation commences.

SUMMARY OF THE INVENTION

The invention has provided a lift line tension limiter which can be connected to a respective attachment device on an object to be salvaged. The lift line tension limiter insures that the forces applied to the various attachment devices on the object to be salvaged are substantially equal. This automatic equalization is effected at the commencement of the lifting operation. The lift line tension limiter includes a lift line and a container which is adapted to contain the lift line. The container has a lift end and payload end, the payload end having an aperture for the passage of the lift line therethrough. A device is spring mounted to the container for pinching the lift line at the container aperture, and after the container aperture the lift line is in frictional engagement with the pinching device so that a force on the lift line will decrease the pinching action on the lift line. With this arrangement a predetermined loading of the lift line will spring bias the pinching means to relieve the pinching action and allow a portion of the lift line to be payed out of the container until the loading has been lessened below the predetermined amount. A lift line tension limiter is used in conjunction with each attachment device so that the automatic equalization of forces on the attachment device takes place at the commencement of the lifting operation.

OBJECTS OF THE INVENTION

An object of the present invention is to provide a device which will limit the tension on a lift line.

Another object is to provide a device which will automatically limit the tension on a lift line as the tension is applied thereto.

A further object is to provide a device which will automatically pay out a portion of a lift line when the tension on the lift line has exceeded a preetermined amount and which will terminate pay out of the lift line when the tension has fallen below the predetermined amount.

Still another object is to provide a lift line tension limiter which is automatic in operation in response to the degree of tension on the lift line, and which is low in cost, trouble free, compact, constructed entirely of mechanical components, and efficient in operation.

Other objects, advantages and novel features of the invention will become apparent from the following detailed description of the invention when considered in conjunction with the accompanying drawings.

DESCRIPTION OF THE PREFERRED EMBODIMENT

Figure 1:
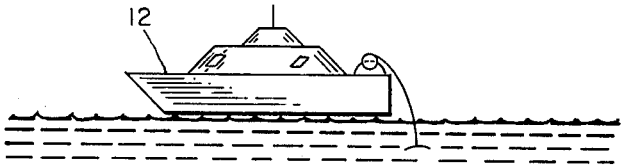
FIG. 1 is an ocean elevational view of the invention in operation.
Figure 1:
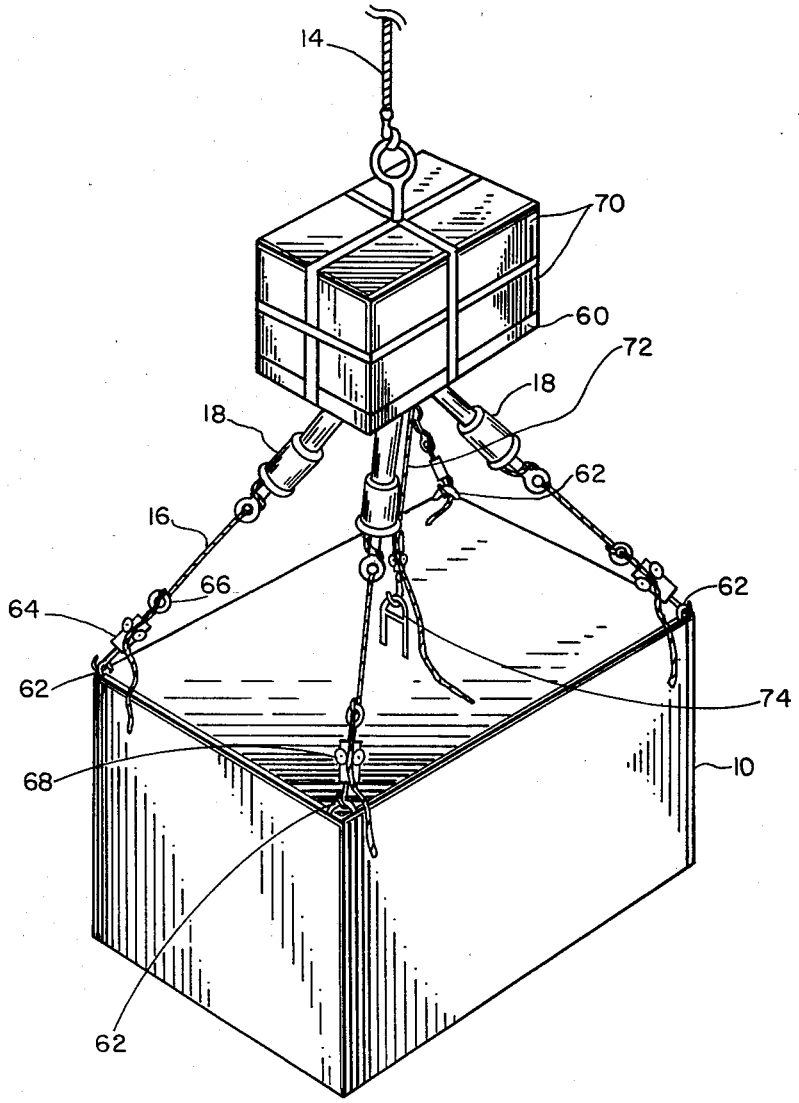

Referring now to the drawings wherein like reference numerals designate like or similar parts throughout the several views there is illustrated in FIG. 1 an object 10 which is being lifted to a surface craft 12 by a primary lift line 14 and secondary lift lines 16. The lift lines 16 are automatically adjusted at a predetermined tension by a plurality of lift line tension limiters 18.

Figure 2:
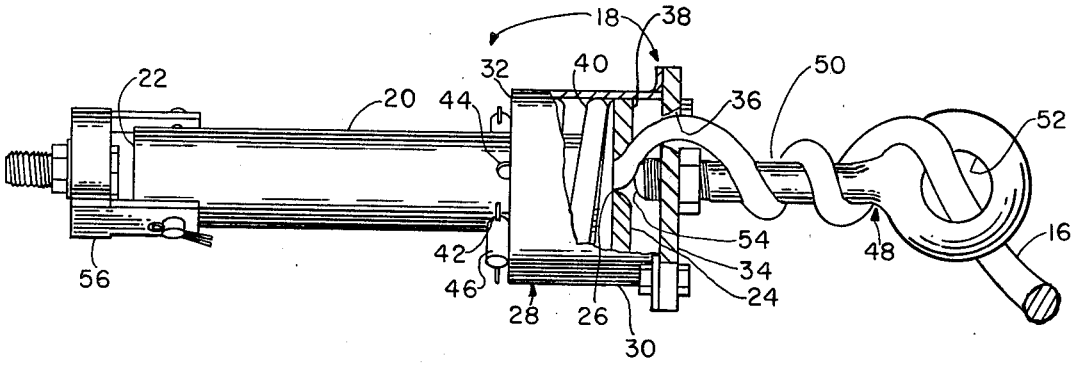
FIG. 2 is a longitudinal view of the tension limiter device in a tight pinching mode and with a portion cut away to show various details thereof.
Figure 3:
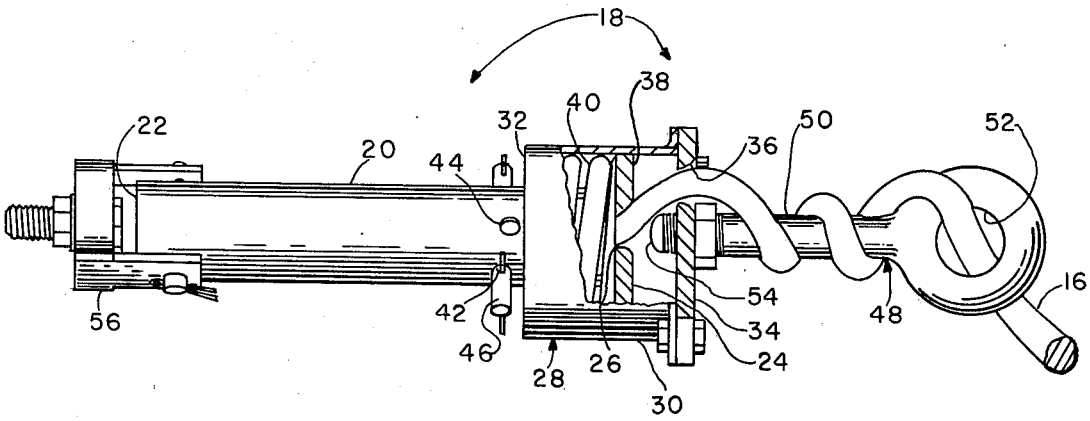
FIG. 3 is similar to FIG. 2 except the pinching action of the lift line has terminated or lessened sufficiently to allow the lift line to be payed out.
Figure 4:
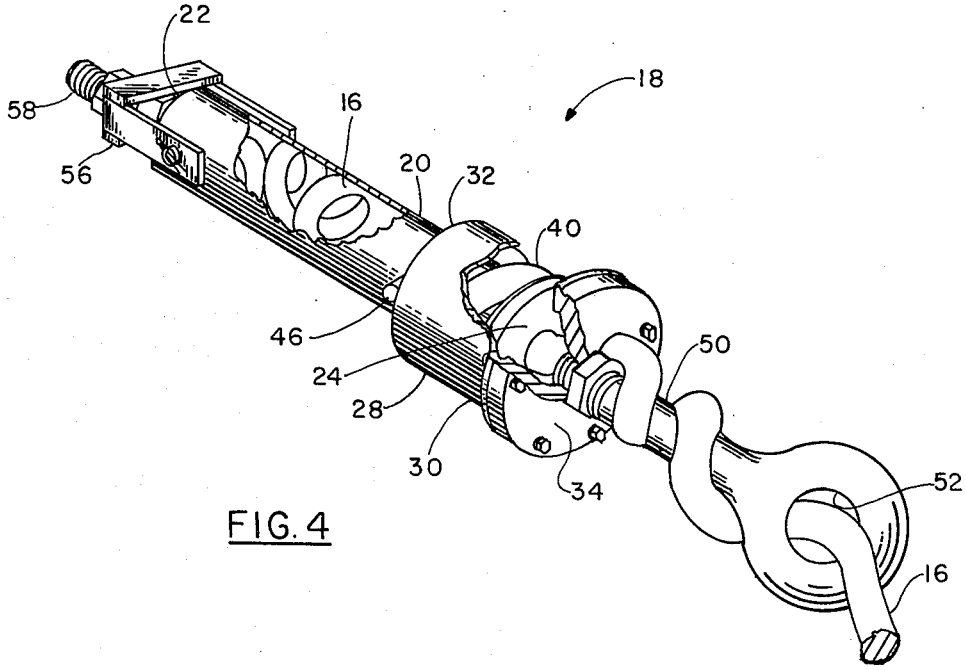
FIG. 4 is an isometric view of the tension limiter device with portions cut away to illustrate various details thereof.

As illustrated in FIGS. 2, 3 and 4, the lift line tension limiter 18 includes the lift line 16 and a container 20 for containing the lift line. The container 20 has a lift end 22 and a payload end 24. The payload end 24 of the container has an aperture 26 which is sized so that the lift line 16 may pass therethrough.

Means, which are generally shown at 28, are spring mounted to the container for pinching the lift line 16 at the container aperture 26. As will be described hereinafter, the lift line 16 is in frictional engagement with the pinching means so that a force on the lift line 16 diminishes the degree of pinching action on the lift line at the container aperture 26.

The pinching means 28 include a casing 30 which has a pair of opposing ends 32 and 34. The end 32 may be provided with an opening for slidably receiving the container 20, and the other end 34 may be provided with an aperture 36 for the passage of the lift line 16 therethrough. The payload end 24 of the container 20 may be provided with a flange portion 38 which is slidable in the casing 30. With this arrangement the payload end 24 of the container is essentially operating as a piston sliding within the container 30 which functions as a cylinder. Spring biasing means, which may include a compression spring 40, may be mounted in the casing 30 about the container 20 between the container flange 38 and the casing end 32. The compression spring 40 biases the casing 30 toward the lift end 22 of the container 20. Means may be provided for adjustably stopping any movement of the casing toward the lift end of the container. The adjustable stopping means may include the container 20 having a plurality of sets of diametrically positioned holes, each set being at different longitudinal positions along the container. As illustrated in FIG. 2, one set of such holes is represented at 42 (only one hole being shown) and another set is represented at 44 (only one hole being shown). The adjustable stopping means further includes a pin 46 which extends through a set of the holes, the pin 46 extending through the set 42 in the drawings. If the pin were withdrawn from this set and placed in the set of holes 44 the compression spring 40 would be compressed tighter, thereby increasing the pinching action on the line 16 at the container aperture 26.

The pinching means 28 may further include an eye bolt 48 which has a shank 50 with a threaded end portion and an eye 52. The threaded end of the eye bolt 48 may be threaded into the casing end 34 and extend a short distance into the casing adjacent the container aperture 26 so as to cooperate with the container aperture 26 for pinching the lift line 16 by action of the spring 40. The threaded portion of the eye bolt may have a rounded end 54 so that the lift line will not be damaged during the pinching operation.

It is preferable that the container 20 and the casing 30 each be generally cylindrical in shape, and that the aperture 26 in the payload end of the container be substantially circular. Further, it is preferable that the longitudinal axes of the container 20, container aperture 26, casing 30, and the shank 50 of the eye bolt be substantially coextensive, and that the casing aperture 36 be laterally offset from the common longitudinal axis.

As illustrated in FIG. 4 the lift line 16 is coiled within the container 20. From this coil the lift line extends through the container aperture 26 and the casing aperture 36. The lift line then may be wrapped around the shank 50 of the eye bolt and extend through the eye 52 thereof. The more turns that the lift line 16 makes around the shank 50 the greater the force will be required to slip the lift line along the shank, and this slippage will occur if the force is sufficient to relieve the pinching action between the threaded eye bolt end 54 and the container aperture 26. Alternatively the lift line 16 could run substantially parallel to the shank 50 and take one or more turns about the eye 52 of the eye bolt for requiring similar type of forces. In FIG. 2 the lift line 16 is shown tightly pinched to prevent the lift line from being drawn from the container 20. However, when the tension on the lift line is sufficient to further compress the spring 40, as illustrated in FIG. 3, the pinching action is lessened and the lift line is payed out of the container 20 until the tension has been lessened.

A clevis 56 may be pivotally connected to the container 20 for receiving the lift force from the primary lift line 14. The clevis may have a threaded portion 58 which may be threaded into the bottom (not shown) of a plate 60. As illustrated in FIG. 1, a plurality of the lift line tension limiters 18 are utilized in order to substantially equalize the lifting forces on the secondary lift lines 16.

For illustration purposes attachment devices 62 are shown fixed to the object 10, one at each corner thereof. These attachment devices may take many different forms such as eye bolt and nut combinations, elements rotated into place for bearing on an inside surface of the object, and/or elements threaded into the object after a drilling and tapping operation. At the bottom end of each secondary lift line 16 there may be connected a slackout device 64 for connection to a respective attachment device 62. The slackout device 64 may be provided with an eye 66 and cam cleats 68. Each secondary lift line may take several turns through the respective eye 66 and thence extend through the cam cleats 68. The cam cleats 68 enable one-way movement of the respective lift line so that the lift lines can be pulled taut through the eye 66 prior to commencement of the lifting operation.

In order to facilitate attachment of the secondary lift lines 16 to the object 10 buoyancy modules 70 may be fixably mounted on top of the plate 60, and a deployment lift line 72 ay securely attach the buoyancy modules 70 to the object 10. The object 10 may be rigged with a cleat 74 for enabling this attachment. The purpose of the deployment line 72 is to enable initial attachment between the plate 60 and the object 10 with the plate floating in a position above the object 10. With this arrangement the secondary lift lines 17 can more easily be attached to the object 10 at the attachment devices 62. This attachment may be implemented either by a diver or a manned or unmanned work vehicle. The primary lift line 14 may then be utilized to implement the lifting operation from the bottom of the ocean to the surface ship 12. As this operation commences the tension limiters 18 will automatically adjust the lengths of the secondary lift lines 16 so as to substantially equalize the tension loads thereon. In one operation utilizing four tension limiters 18 for lifting an in-water weight of an object of 2,800 lbs. each tension limiter was set between 800 and 1,000 lbs. The setting operation is implemented by placing the pin 46 in the proper set of apertures 42 or 44, and taking the required number of turns of the lift line 16 about the eye bolt 48. Each tension limiter should be appropriately calibrated.

Obviously, many modifications and variations of the present invention are possible in the light of the above teachings. It is therefore to be understood that within the scope of the appended claims the invention may be practiced otherwise than as specifically described.

What is claimed is:

1. A lift line tension limiter comprising:

a lift line;

a container which is adapted to contain the lift line and which has a lift end and a payload end, the payload end having a flange, the flange in turn having an aperture for passage of the lift line therethrough;

a casing;

said casing having a pair of opposing ends, one end of the casing having an opening for slidably receiving the container flange and the other end of the casing having an aperture for passage of the lift line therethrough;

a compression spring mounted in the casing about the container between the container flange and the container receiving end of the casing for spring biasing the container flange toward the aperture end of the casing and thereby pinching the lift line therebetween; and said lift line being in frictional engagement with the aperture end of the casing so that increased tension on the lift line lessens the degree of pinching action on the lift line, whereby predetermined tension loading on the lift line will pull the aperture end of the casing away from the container flange to relieve the pinching action and allow a portion of the lift line to be payed out of the container until the tension loading has been lessened below the predetermined amount.

2. A lift line tension limiter as claimed in claim 1 including:

means adjustably stopping slidable movement of the casing toward the lift end of the container.

3. A lift line tension limiter as claimed in claim 2 including:

an eye bolt having its shank fixably extending through the apertured end of the casing;

a portion of the eye bolt shank extending into the casing adjacent the container aperture for causing the pinching of the lift line; and said portion of the eye bolt shank having a rounded end.

4. A lift line tension limiter as claimed in claim 3 including:

the container and the casing each being generally cylindrical.

5. A lift line tension limiter as claimed in claim 4 wherein the adjustable stopping means includes:

the container having a plurality of sets of diametrically positioned holes, each set being at different longitudinal positions along the container; and a pin extending through one of the sets of holes.

6. A lift line tension limiter as claimed in claim 5 including:

the lift line being coiled within the container, thence extending through the container aperture and casing aperture, thence being wrapped around the shank and extending through the eye of the eye bolt.

7. A lift line tension limiter as claimed in claim 6 including:

the container aperture being substantially circular;

the longitudinal axes of the container, container aperture, casing, and the shank of the eye bolt being substantially coextensive; and the casing aperture being laterally offset from said longitudinal axes.

8. A lift line tension limiter as claimed in claim 7 including:

a clevis pivotally connected to the container for receiving the lift force.

9. A tension limiter for a lift line comprising:

a generally cylindrical container which is adapted to contain the lift line, and which has a lift end and a payload end;

a generally cylindrical casing of larger diameter than the container and having a lift end and a payload end, the lift end having an opening for slidably receiving the container and the payload end having an aperture for the passage of lift line therethrough;

the payload end of the container having a flange for reciprocatory movement in the casing between the casing ends;

a compression spring muonted in the casing between the flange and the lift end of the casing for biasing the payload end of the container toward the payload end of the casing;

means for stopping movement of the lift end of the casing toward the lift end of the container;

the payload end of the container having an aperture for the passage of lift line therethrough;

the payload end of the casing having a projection extending inwardly therein adjacent the aperture in the payload end of the container for pinching the lift line in response to the spring force, and thereby preventing payout of the lift line through the container aperture; and means attached to the payload end of the casing and extending exteriorly thereof for frictionally receiving an intermediate portion of the lift line, whereby tension loading of the lift line above a predetermined amount will lessen the pinching action to allow payout of the lift line from the container until the tension is relieved.

10. A tension limiter as claimed in claim 9 including:

the frictionally receiving means being an eye bolt;

the container aperture being substantially circular;

the longitudinal axes of the container, container aperture, casing and shank of the eye bolt being substantially coextensive; and the casing aperture being laterally offset from said longitudinal axes.

11. A tension limiter as claimed in claim 10 including:

the projection being the terminal end of the shank of the eye bolt.

12. A tension limiter as claimed in claim 11 including:

the stopping means being adjustable.

13. A tension limiter for a lift line comprising:

a container which is adapted to contain the lift line and which has a lift end and a payload end, the payload end having a flange, the flange in turn having an aperture for passage of the lift line therethrough;

a casing;

said casing having a pair of opposing ends, one end of the casing having an opening for slidably receiving the container flange and the other end of the casing having an aperture for passage of the lift line therethrough;

a compression spring mounted in the casing about the container between the container flange and the container receiving end of the casing for spring biasing the container flange toward the aperture end of the casing and thereby providing for pinching of the lift line therebetween; and the aperture end of the casing being capable of frictionally engaging the lift line, whereby, upon utilizing the lift line with the tension limiter, predetermined tension loading on the lift line will pull the aperture end of the casing away from the container flange to relieve the pinching action and allow a portion of the lift line to be payed out of the container until the tension loading has been lessened below the predetermined amount.

* * * * *